US008839766B2

(12) United States Patent
Serrano

(10) Patent No.: US 8,839,766 B2
(45) Date of Patent: Sep. 23, 2014

(54) CONTROL OF A PARTIAL CYLINDER DEACTIVATION ENGINE

(71) Applicant: Tula Technology, Inc., San Jose, CA (US)

(72) Inventor: Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 0 days.

(21) Appl. No.: 13/799,389

(22) Filed: Mar. 13, 2013

(65) Prior Publication Data

US 2013/0255626 A1 Oct. 3, 2013

Related U.S. Application Data

(60) Provisional application No. 61/618,322, filed on Mar. 30, 2012.

(51) Int. Cl.
*F02D 17/02* (2006.01)
*F02D 41/00* (2006.01)

(52) U.S. Cl.
CPC ..... *F02D 41/0087* (2013.01); *F02D 2250/21* (2013.01)
USPC ..... 123/481; 123/198 F; 123/198 DB; 123/198 DC

(58) Field of Classification Search
CPC ..... F02D 41/0087; F02D 17/02; F02D 13/06; F02D 2041/0012; F01L 13/0005
USPC ..... 123/481, 198 F, 198 DB, 198 DC
See application file for complete search history.

(56) References Cited

U.S. PATENT DOCUMENTS

| | | | |
|---|---|---|---|
| 2,875,742 | A | 3/1959 | Dolza |
| 3,756,205 | A | 9/1973 | Frost |
| 4,064,844 | A | 12/1977 | Matsumoto et al. |
| 4,129,109 | A | 12/1978 | Matsumoto |
| 4,144,863 | A | 3/1979 | Abdoo |
| 4,172,434 | A | 10/1979 | Coles |
| 4,274,382 | A | 6/1981 | Sugasawa et al. |
| 4,276,863 | A | 7/1981 | Sugasawa et al. |
| 4,306,529 | A | 12/1981 | Chiesa et al. |
| 4,337,740 | A | 7/1982 | Sugasawa et al. |
| 4,391,255 | A | 7/1983 | Staerzl |
| 4,401,069 | A | 8/1983 | Foley |
| 4,434,767 | A | 3/1984 | Kohama et al. |
| 4,489,695 | A | 12/1984 | Kohama et al. |
| 4,509,488 | A | 4/1985 | Forster et al. |
| 4,541,387 | A | 9/1985 | Morikawa |
| 5,117,790 | A | 6/1992 | Clarke et al. |
| 5,374,224 | A | 12/1994 | Huffmaster et al. |

(Continued)

OTHER PUBLICATIONS

Klauer, "Lehrstuhl für Angewandte Thermodyamik," Diploma work Rheinish-Westfälischen Technischen, Aachen, Germany, published Mar. 1983.

(Continued)

*Primary Examiner* — Erick Solis
(74) *Attorney, Agent, or Firm* — Beyer Law Group LLP

(57) ABSTRACT

A variety of methods and arrangements for managing transitions between operating states for an engine are described. In one aspect, an engine is operated in a particular operating state. A transition is made to another operating state. During that transition, the engine is operated in a skip fire manner.

23 Claims, 5 Drawing Sheets

(56) References Cited

U.S. PATENT DOCUMENTS

| | | | | |
|---|---|---|---|---|
| 5,377,631 | A | 1/1995 | Schechter | |
| 5,408,966 | A | 4/1995 | Lipinski et al. | |
| 5,408,974 | A | 4/1995 | Lipinski et al. | |
| 5,431,139 | A | 7/1995 | Grutter et al. | |
| 5,490,486 | A | 2/1996 | Diggs | |
| 5,540,633 | A | 7/1996 | Yamanaka et al. | |
| 5,584,266 | A | 12/1996 | Motose et al. | |
| 5,692,471 | A | 12/1997 | Zhang | |
| 5,720,257 | A | 2/1998 | Motose et al. | |
| 5,769,054 | A | 6/1998 | Schnaibel et al. | |
| 5,778,858 | A | 7/1998 | Garabedian | |
| 5,975,052 | A | 11/1999 | Moyer | |
| 6,138,636 | A | 10/2000 | Kohno et al. | |
| 6,158,411 | A | 12/2000 | Morikawa | |
| 6,244,242 | B1 | 6/2001 | Grizzle et al. | |
| 6,360,724 | B1 | 3/2002 | Suhre et al. | |
| 6,408,625 | B1 | 6/2002 | Woon et al. | |
| 6,615,804 | B2 | 9/2003 | Matthews et al. | |
| 6,619,258 | B2 | 9/2003 | McKay et al. | |
| 6,655,353 | B1 | 12/2003 | Rayl | |
| 6,687,602 | B2 | 2/2004 | Ament | |
| 6,735,938 | B2 | 5/2004 | Surnilla | |
| 6,736,108 | B2 | 5/2004 | Rayl et al. | |
| 6,769,398 | B2 | 8/2004 | Surnilla et al. | |
| 6,782,865 | B2 | 8/2004 | Rayl et al. | |
| 6,874,463 | B1 | 4/2005 | Bolander et al. | |
| 7,032,581 | B2 | 4/2006 | Gibson et al. | |
| 7,044,101 | B1 | 5/2006 | Duty et al. | |
| 7,063,062 | B2 | 6/2006 | Lewis et al. | |
| 7,085,647 | B1 | 8/2006 | Prucka et al. | |
| 7,086,386 | B2 | 8/2006 | Doering | |
| 7,179,199 | B2 | 2/2007 | Kushiyama et al. | |
| 7,198,029 | B1 | 4/2007 | Wong et al. | |
| 7,231,907 | B2 | 6/2007 | Bolander et al. | |
| 7,249,583 | B2 | 7/2007 | Bidner et al. | |
| 7,278,391 | B1 | 10/2007 | Wong et al. | |
| 7,571,707 | B2 | 8/2009 | Gibson et al. | |
| 7,577,511 | B1 | 8/2009 | Tripathi et al. | |
| 7,836,866 | B2 | 11/2010 | Luken et al. | |
| 7,849,835 | B2 | 12/2010 | Tripathi et al. | |
| 7,886,715 | B2 | 2/2011 | Tripathi et al. | |
| 7,930,087 | B2 | 4/2011 | Gibson et al. | |
| 7,931,002 | B1 | 4/2011 | Gibson et al. | |
| 7,954,474 | B2 | 6/2011 | Tripathi et al. | |
| 7,974,769 | B2 | 7/2011 | Shin | |
| 8,099,224 | B2 * | 1/2012 | Tripathi et al. | 701/102 |
| 8,131,445 | B2 | 3/2012 | Tripathi et al. | |
| 8,131,447 | B2 * | 3/2012 | Tripathi et al. | 701/103 |
| 8,336,521 | B2 | 12/2012 | Tripathi et al. | |
| 2002/0157640 | A1 | 10/2002 | Matthews et al. | |
| 2003/0220732 | A1 | 11/2003 | Matthews et al. | |
| 2003/0221653 | A1 | 12/2003 | Brevick et al. | |
| 2008/0154468 | A1 | 6/2008 | Berger et al. | |
| 2010/0010724 | A1 * | 1/2010 | Tripathi et al. | 701/103 |
| 2010/0043744 | A1 | 2/2010 | Suzuki et al. | |
| 2010/0050993 | A1 | 3/2010 | Zhao et al. | |
| 2011/0000459 | A1 | 1/2011 | Elsäβer | |
| 2011/0030657 | A1 | 2/2011 | Tripathi et al. | |
| 2011/0130902 | A1 | 6/2011 | Heisel et al. | |
| 2011/0197860 | A1 | 8/2011 | Aso et al. | |
| 2011/0213540 | A1 | 9/2011 | Tripathi et al. | |
| 2011/0251773 | A1 * | 10/2011 | Sahandiesfanjani et al. | 701/102 |

OTHER PUBLICATIONS

International Search Report dated Aug. 12, 2013 from International Application No. PCT/US2013/033725.

Written Opinion dated Aug. 12, 2013 from International Application No. PCT/US2013/033725.

* cited by examiner

300

CONTROL OF A PARTIAL CYLINDER DEACTIVATION ENGINE

RELATED APPLICATIONS

This application claims priority to U.S. Provisional Patent Application No. 61/618,322, entitled "Control of a Partial Cylinder Deactivation Engine," filed Mar. 30, 2012, which is incorporated by reference herein in its entirety for all purposes.

FIELD OF THE INVENTION

The present invention relates generally to variable displacement engines. Various embodiments involve mechanisms for improving the handling of transitions between operational states.

BACKGROUND

Most vehicles in operation today are powered by internal combustion (IC) engines. Internal combustion engines typically have a plurality of cylinders or other working chambers where combustion occurs. Under normal driving conditions, the torque generated by an internal combustion engine needs to vary over a wide range in order to meet the operational demands of the driver. Over the years, a number of methods of controlling internal combustion engine torque have been proposed and utilized. Some such approaches contemplate varying the effective displacement of the engine. In conventional variable displacement engine operation, a fixed set of cylinders are deactivated during low-load operating conditions. For example, an eight cylinder engine may fire all eight cylinders, then drop to a four cylinder mode (in which four cylinders are fired and four are deactivated). Cylinder deactivation during low-load operating conditions can help reduce fuel consumption.

While the above approaches work well for various applications, there are ongoing efforts to further improve the fuel efficiency and performance of variable displacement engines.

SUMMARY OF THE INVENTION

A variety of methods and arrangements for managing transitions between operating states for an engine are described. In one aspect, an engine is operated in a particular operating state. A transition is made to another operating state. During that transition, the engine is operated in a skip fire manner.

There are a wide variety of ways to operate the working chambers during the transition. In some approaches, for example, a firing algorithm is used to generate fire/skip commands for all available working chambers and selected fire/skip commands are changed depending on the operational state. In other approaches, the firing algorithm is only used for selected working chambers (e.g., those working chambers that are deactivatable.) In still other embodiments, a firing fraction is selected from a library of multiple, predetermined firing fractions and a corresponding firing sequence is generated. Various implementations involve selecting a firing sequence from a library of predetermined firing sequences, rather then generating the sequence dynamically in real time using a firing algorithm.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Figure 1:
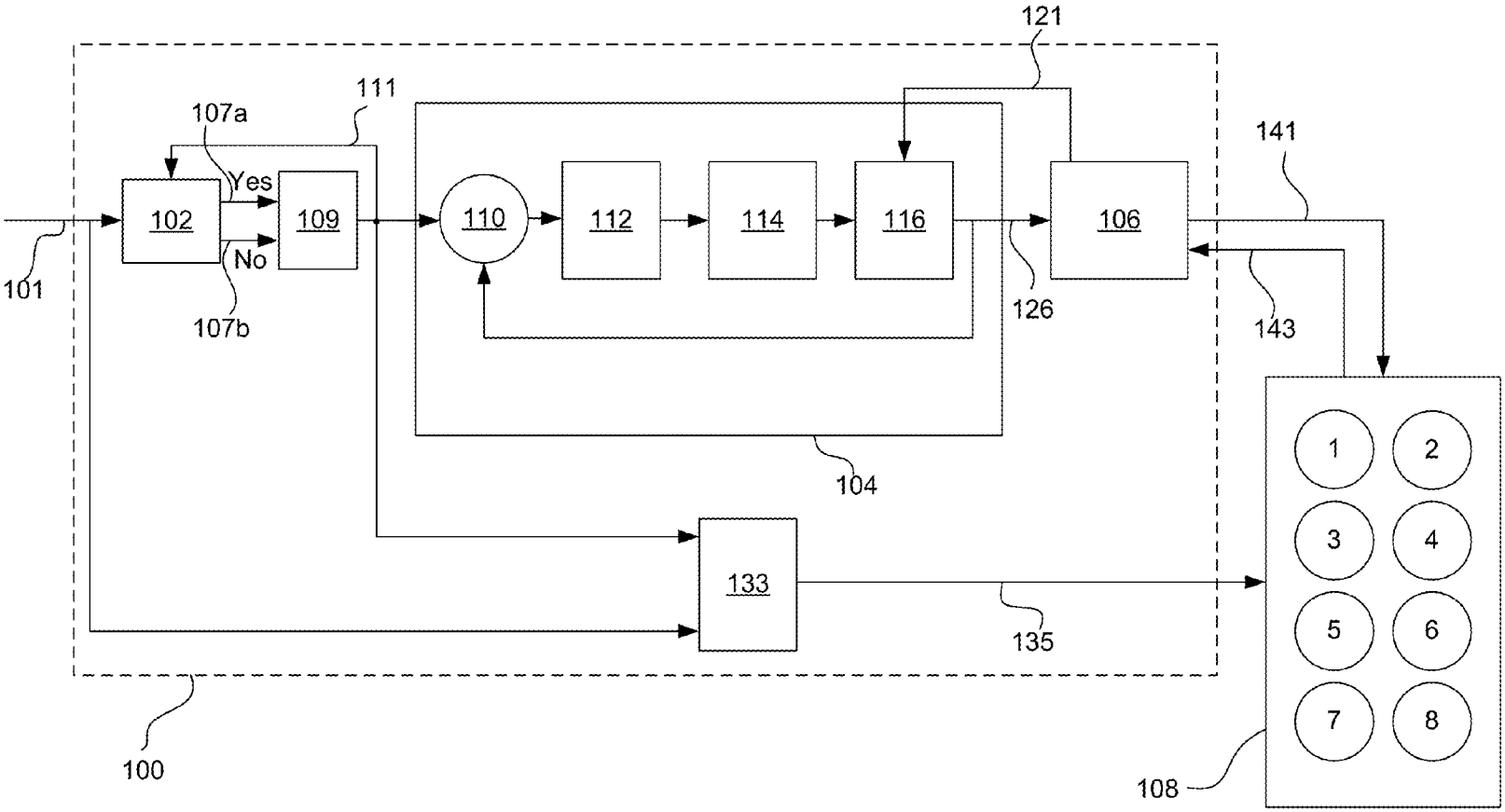
FIG. 1 is a block diagram of an engine controller with a decision modification control unit according to a particular embodiment of the present invention.

The present invention relates generally to control mechanisms for a variable displacement engine. More specifically, various embodiments relate to techniques for managing transitions between different operational states of an engine.

Such transitions can be a challenge for conventional variable displacement engine control. Consider a vehicle with eight cylinders that can switch between two operational states, one which involves firing all eight cylinders (eight cylinder mode) and another that involves deactivating four of the cylinders (four cylinder mode). When transitioning from an eight cylinder mode to a four cylinder mode, the power output of the engine doubles, if it is assumed that all other engine parameters (engine speed, manifold absolute pressure, etc.) remain the same. This steep increase in power output can generate undesirable noise, vibration and harshness (NVH).

With a conventional variable displacement engine, these problems are more difficult to manage at higher torque levels. Thus, transitions from, for example, a lower cylinder mode to a higher cylinder mode, are generally made very early under low load conditions. That is, the engine will automatically leave four cylinder mode and move to an eight cylinder mode even when the desired torque level could easily be handled by four cylinders. Since the engine is operating in an eight cylinder mode far more than necessary, potential fuel efficiency gains are lost.

The present application describes various techniques for improving the management of transitions between different operational states. In various implementations, each operational state involves a predetermined number of deactivatable working chambers and a predetermined number of working chambers that are non-deactivatable i.e., that are fired at every firing opportunity during a particular operational state. (Any of the aforementioned numbers may be zero or higher.) During the transition between the different operational states, the deactivatable working chambers are fired or deactivated in a skip fire manner. In various embodiments, the skip fire firing sequence is selected to reduce or eliminate NVH problems and facilitate a smooth transition between operational states.

For example, consider again the vehicle with an eight cylinder engine that was discussed earlier. If skip fire engine control is used as described above, the transition between the four cylinder mode and the eight cylinder mode can be better managed even at greater torque levels. As a result, the engine can remain in the four cylinder mode for longer periods of time, thereby improving the fuel efficiency of the engine.

Generally, skip fire engine control involves deactivating one or more selected working cycles of one or more working chambers and firing one or more working cycles of one or more working chambers. Individual working chambers are sometimes deactivated and sometimes fired. In various skip fire applications, individual working chambers have firing patterns that can change on a firing opportunity by firing opportunity basis. For example, an individual working chamber could be skipped during one firing opportunity, fired during the next firing opportunity, and then skipped or fired at the very next firing opportunity. The present invention contemplates a wide variety of techniques for directing firings in a skip fire manner. The assignee of the present application has filed multiple applications involving skip fire engine operation, including U.S. Pat. Nos. 7,954,474; 7,886,715; 7,849,835; 7,577,511; 8,099,224; 8,131,445; 8,131,447; and 8,336,521; U.S. patent application Ser. Nos. 13/004,839 and 13/004,844; and U.S. Provisional Patent Application Nos. 61/639,500; 61/672,144; 61/441,765; 61/682,065; 61/677,888; 61/683,553; 61/682,151; 61/682,553; 61/682,135; 61/682,168; 61/080,192; 61/104,222; and 61/640,646, each of which is incorporated herein by reference in its entirety for all purposes. Many of the aforementioned applications describe engine controllers, firing fraction calculators, filters, power train parameter adjusting modules, firing timing determination modules, ECUs and other mechanisms that may be incorporated into any of the described embodiments to generate, for example, a suitable firing fraction, skip fire firing sequence or torque output.

The sequence of firings used to operate the engine can be generated in a wide variety of ways, depending on the needs of a particular application. One example approach is shown in FIG. 1. FIG. 1 is a block diagram illustrating an engine controller 100 according to a particular embodiment of the present invention. The engine controller 100 includes an operational state module 102, a firing fraction calculator 109, a power train parameter adjusting module 133, a firing timing determination module 104, and a fire control unit 106, which is coupled with the engine 108. The firing timing determination module 104 may include a sigma delta converter having an adder 110, an integrator 112, a quantizer 114 and a decision modification control unit 116. In this particular example, the engine 108 has eight cylinders that can be operated in a four cylinder mode (e.g., working chambers 2, 3, 5 and 8 can be selectively fired or deactivated while the other working chambers are fired at every firing opportunity), although the engine controller 100 may be modified as appropriate for any number of working chambers and different operational states.

Initially, an engine output request 101 is generated. Any suitable mechanism may be used to generate the engine output request, which may be based on the accelerator pedal position and a variety of other engine operating parameters, such as the engine speed, transmission gear, rate of change of accelerator pedal position or cruise control setting. The engine output request 101 is directed to the operational state module 102. The operational state module 102 records the current engine operational state and determines whether the current operating state is suitable for the engine output request 101. If the current operational state is suitable with the engine output request, engine control proceeds along the "yes" decision path 107*a*, which is acted upon by the firing fraction calculator 109.

The firing fraction calculator 109 is arranged to determine a firing fraction that would be appropriate to deliver the desired output. The firing fraction is indicative of the fraction or percentage of firings under the current (or directed) operating conditions that are required to deliver the desired output. In the above case, the "yes" decision path 107*a* causes the firing fraction calculator 109 to output a fixed firing fraction that corresponds to the current operational state. In the current example, the engine has two operational states, corresponding to a firing fraction of ½ and 1. The firing fraction calculator 109 outputs a firing fraction signal 111 which is directed to the power train adjusting module 133, the firing timing determination module 104 and the operational state module 102.

The power train parameter adjusting module 133 is adapted to adjust selected power train parameters to adjust the output of each firing so that the actual engine output substantially equals the requested engine output 101 given the current firing fraction. Therefore, the power train parameter adjusting module 133 is arranged to adjust some of the engine's operational parameters appropriately so that the actual engine output when using the current firing fraction matches the desired engine output. As will be appreciated by those skilled in the art, a number of parameters can readily be altered to adjust the torque delivered by each firing appropriately to ensure that the actual engine output using the current firing fraction matches the desired engine output. By way of examples, parameters such as throttle position, spark advance/timing, intake and exhaust valve timing, fuel charge, etc., can readily be adjusted to provide the desired torque output per firing. The output 135 of the power train parameter adjusting module 133 is directed to the engine where these parameters are adjusted.

The firing fraction 111 is also fed to the firing timing determination module 104. The firing timing determination module 104 is arranged to issue a sequence of firing commands (e.g., firing command 126) that cause the engine 108 to deliver the desired percentage of firings. The firing sequence is used to operate the working chambers of the engine 108 so that they are selectively fired or skipped in accordance with the sequence. The module 104 may take a wide variety of forms. In this example, the module 104 is a modified first order sigma delta converter, which includes an adder 110, integrator 112, quantizer 114 and a decision modification control unit 116. The firing sequence can be determined using any suitable technique (e.g., an algorithm, a lookup table, etc.).

In the illustrated embodiment, the adder 110 receives the firing fraction 111 from the firing fraction calculator 109 and a firing command signal 126, which is part of a feedback loop. The output of the adder 110 is sent to the integrator 112. A quantizer 114 receives the output of the integrator 112 and generates a sequence of values indicating individual firing/skip decisions (e.g., a bitstream in which a 0 indicates a skip and a 1 indicates a fire.) This sequence is received at the decision modification control unit 116.

The decision modification control unit 116 also receives input 121 from the fire control unit 106 that indicates which working chamber the current firing opportunity applies to. The fire control unit 106 may receive a signal 143 from the engine 108 indicative of the working chamber associated with the current firing opportunity. The next firing decision then may be altered depending on the current operational state and whether the working chamber is capable of being deactivated or not. Consider the example shown in FIG. 1, in which the working chambers are numbered 1 through 8 and in which only working chambers 2, 3, 5 and 8 can be deactivated. Assume further that the output of the quantizer 114 indicates that there should be a skip at the next firing opportunity. If the current working chamber is one of working chambers 1, 4, 6 and 7, then the skip command will be changed to a fire command by decision modification control unit 116, since working chambers 1, 4, 6 and 7 cannot be deactivated. The firing command output 126 of the decision modification control unit 116 will thus be a "1" instead of a "0". The firing command signal 126 is directed in two paths. One path is routed back to the adder 110 through a feedback loop, thereby ensuring that the overall firing sequence generated by the firing timing determination module 104 delivers the percentage of firings dictated by the firing fraction 111. The second path is directed to the fire control unit 106. The fire control unit 106 then generates firing signal 141 that operates the current working chamber so that it is fired based on the "1" received in command 126.

In this example, if the current working chamber can be deactivated (e.g., one of the working chambers 2, 3, 5 and 8) and the command from the quantizer 114 is a "0", then the command is not modified in the decision modification control unit 116. The decision modification control unit will direct a "0" (skip) signal to the fire control unit 106 and the adder 110. Similarly, if the output of the quantizer 114 is a "1" (fire) the decision modification control unit 116 will not modify the firing decision. Effectively the decision modifier 106 alters the firing sequence, so it is compatible with the current operational state, without altering the average firing fraction.

The firing fraction 111 is also directed to the operational state module. In the illustrated embodiment, once the firing fraction 111 equals that of the current operational state, the operational state module 102 resets to the new operational state. Engine operation proceeds in that operational state, until the "no" signal is generated in the operational state module 102.

Consider now the case where the current operational state is not suitable for the engine output request. In some cases an operational state having a higher firing fraction capable of producing a higher output may be suitable, since it can deliver a higher output level. Alternatively, in some cases an operational state having a lower firing fraction may be suitable, since it can deliver greater fuel economy.

Again consider an example engine having a set of four cylinders that cannot be deactivated and four cylinders that can be deactivated. This engine can have two operational modes. One is a four cylinder operational state, which has the four cylinders that cannot be deactivated firing and the four cylinders that can be deactivated skipping. The other operational state is an eight cylinder operational state, which has the four cylinders that cannot be deactivated firing and the four cylinders that can be deactivated firing as well. The maximum engine output when operating in the four cylinder state is less than that available when operating in the eight cylinder state. Assume the engine is initially operating in the four cylinder operational state. If the engine output request 101 becomes sufficiently high, it cannot be supported by the four cylinder operational state. In this case, the engine must transition to an eight cylinder state that is capable of producing a higher engine output. This causes the engine controller 100 to begin the transition to the eight cylinder operational state. In this case engine control proceeds along the "no" decision path 107*b* from operational state module 102.

Decision path 107*b* is directed to the firing fraction calculator 109. The firing fraction calculator 109 generates a firing fraction 111; however, in this case the firing fraction varies with time over the course of the transition between the operational states. This contrasts with the early case where the firing fraction was a fixed value corresponding to an operational state. In this case, at the beginning of the transition, the firing fraction is 0.5, corresponding to four of eight of the cylinders firing. At the end of the transition the firing fraction will be 1, corresponding to eight of eight cylinders firing. The firing fraction calculator may smoothly transition the firing fraction between these values during the transition. Many of the aforementioned co-assigned applications refer to a firing fraction calculator or other processes for calculating a suitable firing fraction based on an engine output request. Such mechanisms may be incorporated as appropriate into the described embodiment.

The previous example described the situation where the engine output request exceeded what could be supplied by the current operational state, causing the engine to transition to an operational state having a higher firing fraction. Similarly, if the current operational state is capable of producing a high output level and the engine output request is low, the engine can transition to an operational state with a lower firing fraction. Operation in this state may advantageously provide improved fuel economy.

It should be noted that the actual time required to make the transition from one operational state to another operational state is generally very brief. For example, in some embodiments, the total duration of the transition is less than one, two, three or five seconds. The aforementioned skip fire control is performed during this brief period to facilitate the shift between different operational states.

Figure 2:
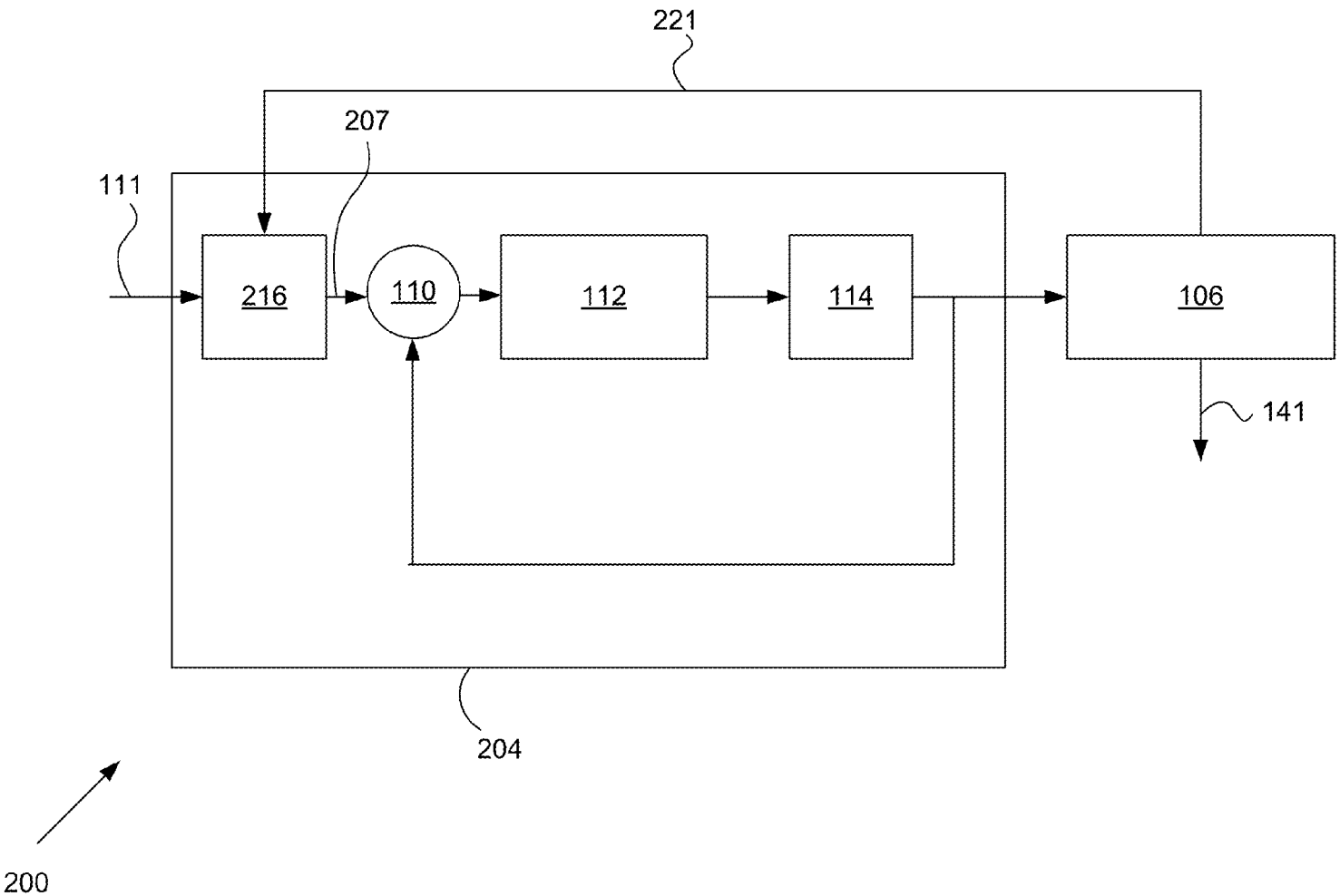
FIG. 2 is a block diagram of a portion of an engine controller with a decision modification control unit according to another embodiment of the present invention.

Referring next to FIG. 2, a block diagram of a portion of an engine controller 200 with a firing timing determination module 204 and fire control unit 106 according to another embodiment of the present invention will be described. The firing timing determination module 204 includes an adder 110, a decision modification control unit 216, an integrator 112 and a quantizer 114. Generally, the adder 110, integrator 112, and quantizer 114 perform the same or similar functions as their corresponding modules in FIG. 1. The firing control unit 106 also performs generally the same function as the corresponding unit in FIG. 1. It directs a firing signal 141 to an engine (not shown in FIG. 2).

One difference between the figures is the positioning and operation of the decision modification control unit 216. In the engine controller 100 of FIG. 1, a firing command was generated using a sigma delta firing algorithm and then was modified depending on the working chamber and the current operational state. In the firing timing determination module 204 of FIG. 2, the decision modification control unit 216 receives the firing fraction 111 and is arranged to prevent the sigma delta firing algorithm from being applied to non-deactivatable working chambers during the current operational state. That is, the sigma delta firing algorithm, which involves the adder 110, integrator 112 and quantizer 114, is used to dynamically generate a firing command only for the deactivatable working chambers.

Figure 3:
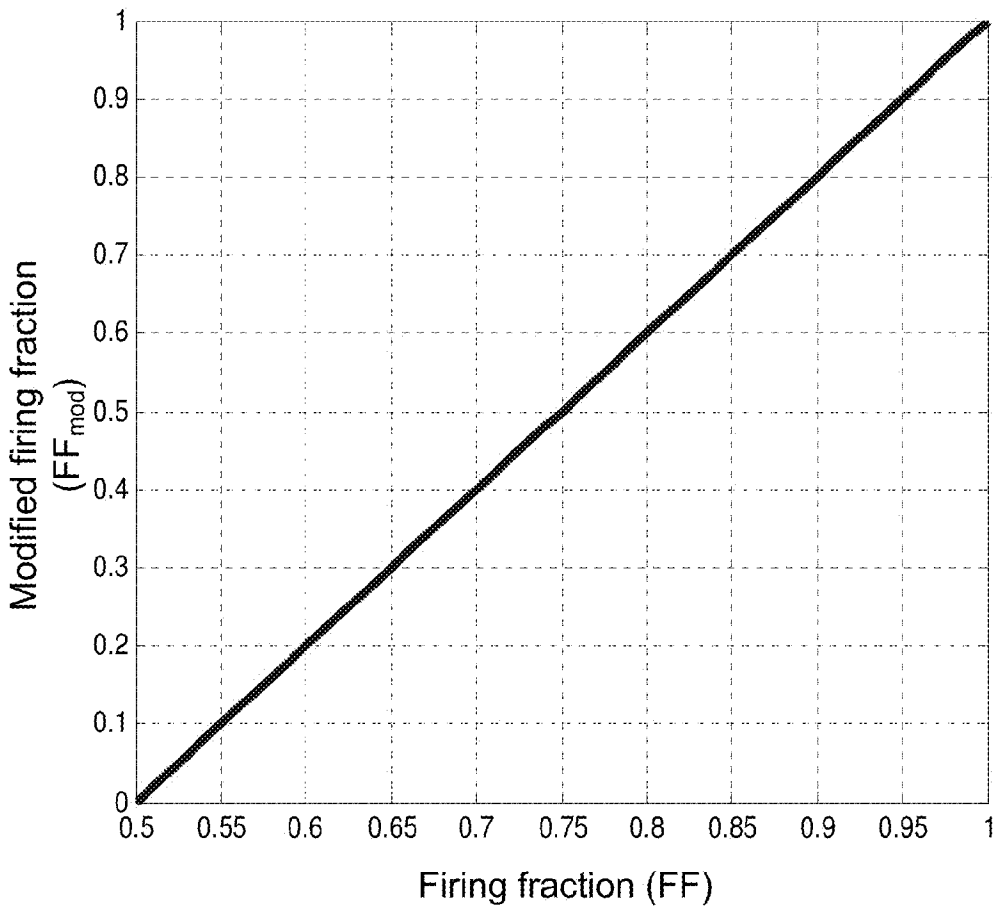
FIG. 3 is a graph indicating a sample relationship between firing fractions for different numbers of working chambers in an engine according to a particular embodiment of the present invention.

In the illustrated embodiment, the decision modification control unit 216 accomplishes the above by calculating a new firing fraction, $FF_{mod1}$ 207, based on the received firing fraction (FF) 111. While FF represents a percentage of firings performed by all the working chambers to deliver a desired torque, $FF_{mod}$ 207 indicates a percentage of firings performed by only the deactivatable working chambers. For example, consider an eight cylinder engine and a particular operational state in which four cylinders can be deactivated, four are always active and the desired firing fraction is ⅔. In this case, $FF_{mod}=2*FF-1$ or ⅓. An example of a correlation between $FF_{mod}$ and FF given the above engine parameters is illustrated in the graph 300 of FIG. 3.

Referring back to FIG. 2, the decision modification control unit 216 receives input 221 from the fire control unit 106 indicating whether the current working chamber (i.e., the working chamber for which a firing command is required or requested) is deactivatable. If the current working chamber is not deactivatable, the $FF_{mod}$ is not passed on to the adder 110 and no firing command is generated for the current working chamber from the sigma delta firing algorithm. Consequently, the firing algorithm is only applied to those working chambers that can be deactivated, and this subset of the working chambers is operated to deliver the firing fraction $FF_{mod}$. The firing control unit 106 operates the other working chambers to be always fired at every firing opportunity for the duration of the current operational state.

Figure 4:
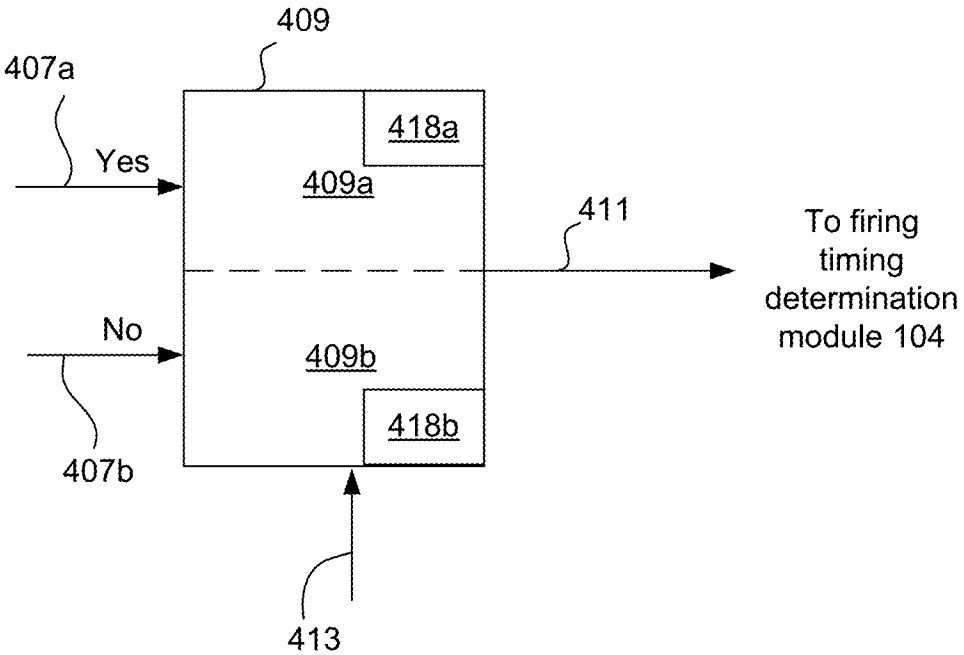
FIG. 4 is a block diagram showing more detail on a firing fraction calculator with a firing fraction library according to a particular embodiment of the present invention.

Referring next to FIG. 4, a block diagram showing more detail on a firing fraction calculator 409 according to another embodiment of the present invention will be described. Firing fraction calculator 409 may, for example, be the firing fraction calculator 109 of FIG. 1. In the illustrated embodiment, the firing fraction calculator 409 is divided into two distinct parts; the state calculator 409*a* and the transition calculator 409*b*. The part currently in control is determined by the input signals 407*a* and 407*b* which may be generated by an operational state module (not shown in FIG. 4). The state calculator 409*a* is used to generate the firing fraction corresponding to a fixed operational state. The output firing fraction 111 in this case is a constant value, such as ¼, ½, ¾, 1 etc. The number of possible values corresponds to the number of operational states in the engine. The transition calculator 409*b* is used to generate the firing fraction during a transition between different operational states. If this portion has control, the output firing fraction 111 is a time varying value. Independent of where the firing fraction signal 111 is generated it may be directed to a firing determination module (not shown in FIG. 4) that may function in an analogous manner to that previously described in FIG. 1.

In one aspect the firing fraction calculator 409 may contain one or more firing libraries 418*a* and 418*b*. In various embodiments, the firing fraction signal library 418*a* is arranged to contain a list of firing fractions that correspond to each operational state. The firing fraction signal library 418*b* is arranged to select a suitable firing fraction from a library of multiple predefined firing fractions to help manage a transition between different operational states. Generally, library 418*a* contains at least two steady-state firing fractions that correspond to the two operational states.

In various implementations, the firing fraction signal library 418*b* receives one or more parameters 413 indicative of the current engine operating conditions and/or the requested engine output. Based on this input second portion 409*b* selects an appropriate firing fraction trajectory to transition between the initial and final operational state. For example, the firing fraction selection may be made based on a defined algorithm, such as an exponential signal, piecewise linear signal, an S-type shaped curve, and/or any other suitable parametrically determined mathematical function. In some embodiments, the selection of the firing fraction is based (directly or indirectly) on the filling (or emptying) rate of the intake manifold.

The firing fraction can also be selected based on the amount of time that has passed since the beginning of a transition from one operational state to another. In some implementations, the firing fraction is a linear function of time. In other embodiments, the relationship between time and the firing function is non-linear and/or calibrated to improve NVH or fuel efficiency. Once the firing fraction is selected from the library, it is then transmitted to a firing timing determination module (not shown in FIG. 4) which may function in a manner previously described in connection with FIG. 1 or 2. The balance of the engine control may also proceed in an analogous manner to that previously described.

Figure 5:
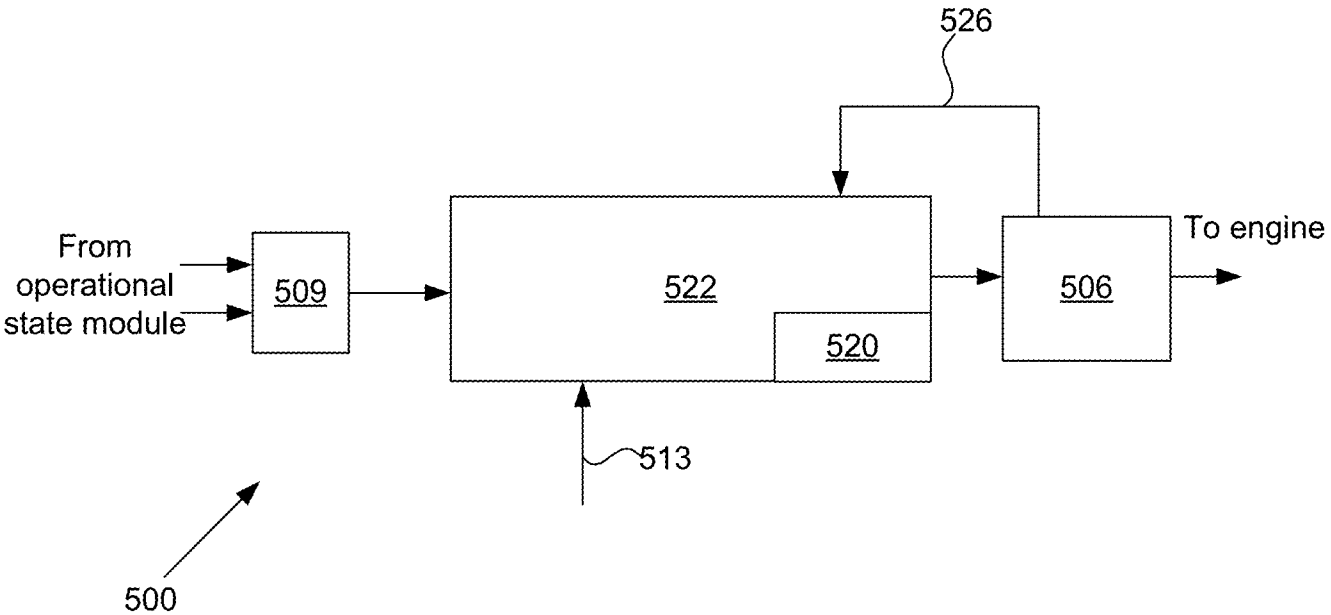
FIG. 5 is a block diagram showing a portion of an engine controller with a firing sequence library according to a particular embodiment of the present invention.

Referring next to FIG. 5, a block diagram including a portion of an engine controller 500 according to another embodiment of the present invention will be described. The engine controller 500 includes a firing fraction calculator 509, a pattern/engine synchronization unit 522 and a fire control unit 506.

The main difference between this embodiment and previously described embodiments is that the firing timing determination module has been replaced by the pattern/engine synchronization unit 522. Rather than calculating a firing sequence as previously described, pattern/engine synchronization unit 522 determines an appropriate firing sequence based on a library or set of predefined firing sequences 520. During a transition between operational states, the firing decision sequence library 520 selects a firing sequence from a library or set of predefined firing sequences. The selection may be performed based on a wide variety of criteria 513, including pedal position, time, any of the criteria used by the firing fraction signal libraries 418*a* and 418*b* to select a firing fraction, etc. The firing sequences are generally chosen to provide for a smooth transition from one operational state to another, and may include any of the firing sequences that would be generated by the firing timing determination modules from FIGS. 1, 2 and 4. Once a suitable firing sequence is selected, the sequence is sent to the fire control unit 506. In addition to firing sequences generated during transitions between operational states, the pattern/engine synchronization unit 522 may also generate firing sequences appropriate for an operational state.

For proper operation, pattern engine/synchronization unit 522 receives a working chamber number or identifier along signal line 526 from the fire control unit 506 and matches an individual firing command from the firing sequence with a designated working chamber. The pattern engine/synchronization unit 522 ensures that a command to skip a working chamber is not matched with a working chamber that must always remain active for the duration of the operational state. The fire/skip commands are then sent from the pattern engine/synchronization unit 522 to the fire control unit 106, which helps orchestrate the actual firings as previously described.

The mechanisms used to select and execute the firing sequences stored in the firing decision sequence library 520 may vary widely, depending on the needs of a particular application. In various embodiments, for example, there are multiple stored firing sequences and one is selected based on one or more criteria, as described above. Some implementations involve using a particular firing sequence when transitioning from a first operational state to a second operational state, and then using the same firing sequence, but in reverse order, when transitioning from the second operational state to the first. Steady-state firing sequences that correspond to the operational states may also be stored in library 520. In some approaches, there are therefore very few stored firing sequences, while in other implementations, the number of stored sequences may be substantially larger.

In many preferred implementations the engine controller and/or firing timing determination module makes a discrete firing decision on a working cycle by working cycle basis. This does not mean that the decision is necessarily made at the same time as the actual firing. Thus, the firing decisions are typically made contemporaneously, but not necessarily synchronously, with the firing events. That is, a firing decision may be made immediately preceding or substantially coincident with the firing opportunity working cycle, or it may be made one or more working cycles prior to the actual working cycle. Furthermore, although many implementations independently make the firing decision for each working chamber firing opportunity, in other implementations it may be desirable to make multiple (e.g., two or more) decisions at the same time.

The invention has been described primarily in the context of controlling the firing of 4-stroke piston engines suitable for use in motor vehicles. However, it should be appreciated that the described skip fire approaches are very well suited for use in a wide variety of internal combustion engines. These include engines for virtually any type of vehicle—including cars, trucks, boats, construction equipment, aircraft, motorcycles, scooters, etc.; and virtually any other application that involves the firing of working chambers and utilizes an internal combustion engine. Although some examples in the application refer to the use of two operational states (four cylinder mode and eight cylinder mode) in engines with eight working chambers, the present invention contemplates using engines having any number of operational modes or working chambers. For example, the embodiments described herein could also be applied to a six cylinder engine that is arranged to transition between three cylinder and six cylinder modes (3/6); 2/4/6 cylinder modes; 2/4/6/8 cylinder modes, 3/4/6 cylinder modes, etc. The various described approaches work with engines that operate under a wide variety of different thermodynamic cycles—including virtually any type of two stroke piston engines, diesel engines, Otto cycle engines, Dual cycle engines, Miller cycle engines, Atkinson cycle engines, Wankel engines and other types of rotary engines, mixed cycle engines (such as dual Otto and diesel engines), radial engines, etc. It is also believed that the described approaches will work well with newly developed internal combustion engines regardless of whether they operate utilizing currently known, or later developed thermodynamic cycles.

In some preferred embodiments, the firing timing determination module 104, 204 and 404 utilize sigma delta conversion. Although it is believed that sigma delta converters are very well suited for use in this application, it should be appreciated that the converters may employ a wide variety of modulation schemes. For example, pulse width modulation, pulse height modulation, CDMA oriented modulation or other modulation schemes may be used to deliver the firing command sequence. Some of the described embodiments utilize first order converters. However, in other embodiments higher order converters may be used.

Although the figures of the application illustrate various distinct modules and submodules, it should be appreciated that in other implementations, any of these modules may be modified, combined or rearranged as appropriate. The functionality of the illustrated modules may also be incorporated into modules described in the aforementioned co-assigned patent applications. For example, some of these patent applications refer to an engine control unit (ECU). Various implementations contemplate incorporating the engine controllers illustrated in FIGS. 1, 2, 4 and 5 into the ECU. Additionally, it should be understood that any of the features or functions described in the prior co-assigned patent applications may be incorporated into the embodiments described herein.

In the previous examples there were only two operational states; however, the concepts described are equally applicable for engines having more than two operational states. In this case the operational state module will determine which of the possible operational states the controller will transition too. For example, an engine may have three operational states correspond to the firing of 4, 6, and 8 cylinders. Depending on the current operational state and requested engine output the controller may cause the engine to shift between 4 cylinder and 8 cylinder operation without an intermediate operational state of 6 cylinders. In other cases, the engine may transition between adjacent operational states.

While several embodiments of the invention have been described in which the operational states correspond to the engine hardware architecture, such as having a certain fixed number of cylinders that cannot be deactivated and having a certain fixed number that can be deactivated, this is not a requirement. For example, an engine having a set of four cylinders that cannot be deactivated and four cylinders that can be deactivated has been described. This engine can have two operational modes. One is a four cylinder operational state, which has the four cylinders that cannot be deactivated firing and the four cylinders that can be deactivated skipped. The other operational state is an eight cylinder operational state, which has the four cylinders that cannot be deactivated firing and the four cylinders that can be deactivated firing as well. However, this engine may have three operational states corresponding to four, six, and eight cylinders firing. In the six cylinder operational state, the four cylinders that cannot be deactivated are firing and two of the four cylinders that can be deactivated are firing and two are skipped. Which individual cylinders are fired and skipped may be varied in this operational state. Similarly this engine could have four or more operational states, each of which corresponds to a certain cylinder firing/skipping configuration. The operational states need not have an integer number of firing cylinders, but may have a fixed pattern of skipped and fired cylinders. The invention described here is equally applicable to engines where all cylinders are capable of deactivation. For example, a V8 engine could have operational states that correspond to firing fractions of ⅓, ⅔, and 1.

A possible approach to engine control in an operational state that does not correspond to the number of cylinders that can be deactivated is explained in the example below. The example illustrates sample firing sequences for engine cycles 1 through 11 and cylinders 1 through 8. A "1" indicates a fire and a "0" indicates a skip. In this example, the operational state corresponds to a firing fraction of ⅔. The cylinders 1, 4, 6 and 7 are non-deactivatable and must always fire. To maintain an overall firing fraction of ⅔, the remaining cylinders that can be deactivated (2, 3, 5, and 8) are sometimes fired and sometimes skipped in a skip fire manner as indicated below:

| | Rev Number | | | | | | | | | | |
|---|---|---|---|---|---|---|---|---|---|---|---|
| | 1 | 2 | 3 | 4 | 5 | 6 | 7 | 8 | 9 | 10 | 11 |
| Cyl 1 | 1 | 1 | 1 | 1 | 1 | 1 | 1 | 1 | 1 | 1 | 1 |
| Cyl 8 | 1 | 0 | 0 | 1 | 0 | 0 | 0 | 0 | 0 | 1 | 0 |
| Cyl 7 | 1 | 1 | 1 | 1 | 1 | 1 | 1 | 1 | 1 | 1 | 1 |
| Cyl 2 | 0 | 0 | 1 | 0 | 0 | 1 | 0 | 0 | 1 | 0 | 0 |
| Cyl 6 | 1 | 1 | 1 | 1 | 1 | 1 | 1 | 1 | 1 | 1 | 1 |
| Cyl 5 | 0 | 1 | 0 | 0 | 1 | 0 | 0 | 1 | 0 | 0 | 1 |
| Cyl 4 | 1 | 1 | 1 | 1 | 1 | 1 | 1 | 1 | 1 | 1 | 1 |
| Cyl 3 | 1 | 0 | 0 | 1 | 0 | 0 | 1 | 0 | 0 | 1 | 0 |

Although only a few embodiments of the invention have been described in detail, it should be appreciated that the invention may be implemented in many other forms without departing from the spirit or scope of the invention. For example, FIG. 4 illustrates a firing fraction signal library 418 that communicates with a firing timing determination module 404 that is similar or identical to the one illustrated in FIG. 1. It should be appreciated, however, that the firing fraction signal library 418 can also be incorporated into any of the described engine controllers (such as engine controller 200 of FIG. 2) to generate a suitable firing fraction. Also, there are references in the application and claims to operational states. It should be understood that the present application contemplates a wide variety of operational state implementations. In some approaches, for example, an operational state involves a predetermined number of deactivatable working chambers and a predetermined number of non-deactivatable working chambers. (The aforementioned numbers may be zero or higher). Thus, different operational states have different numbers of non-deactivatable and deactivatable working chambers. In other embodiments, an operational state involves a particular firing fraction. Thus, different operational states involve firing selected working chambers to deliver different firing fractions. In some implementations, the working chambers that are non-deactivatable and deactivatable are fixed while the corresponding operational state is in effect; in other implementations, this is not required and any or all of the working chambers may fire during one engine cycle and be skipped during the next. Some approaches contemplate two different operational states that have the same number of predetermined, non-deactivatable working chambers, but are different in that each operational state requires operating the deactivatable working chambers to deliver different firing fractions. Additionally, the present application discusses various way of transitioning between two different operational states. It should be appreciated that during the transition, the working chambers of the engine may be operated in accordance with one of those two operational states, or in accordance with a third, distinct operational state. Therefore, the present embodiments should be considered illustrative and not restrictive and the invention is not to be limited to the details given herein.

What is claimed is:

1. A method for managing transitions between operational states of an internal combustion engine having a plurality of working chambers, the method comprising:

operating the engine in one of a first displacement and a second displacement, each displacement having an associated fixed set of active working chambers, wherein the number of active working chambers associated with the first displacement is different than the number of active working chambers associated with the second displacement and wherein the number of active working chambers associated with each of the first and second displacements is greater than zero;

making a transition between the first displacement and the second displacement; and operating the engine in a skip fire manner during the transition wherein the transition between the first and second displacements has a duration of less than two seconds and wherein during skip fire operation at least one of the active working chambers is fired during a first working cycle, skipped during a subsequent second working cycle and fired during a third working cycle that is subsequent to the second working cycle, the first, second and third working cycles occurring during the transition.

2. A method as recited in claim 1 wherein the first and second displacements each involve different, predetermined numbers of non-deactivatable working chambers that are fired at every engine cycle during a particular operational state.

3. A method as recited in claim 1 wherein operating the engine in a skip fire manner involves deactivating at least one selected working cycle of at least one selected working chamber and firing at least one selected working cycle of at least one selected working chamber wherein individual working chambers are sometimes deactivated and sometimes fired.

4. A method as recited in claim 1 wherein the operating of the engine in a skip fire manner further comprises:

generating a firing sequence that includes one or more firing and skip commands for operating the working chambers of the engine;

determining which working chamber a particular skip command would be applied to;

if the skip command involves a deactivatable working chamber, skipping the deactivatable working chamber; and if the skip command involves a non-deactivatable working chamber, firing the non-deactivatable working chamber.

5. A method as recited in claim 1 wherein the operating of the engine in a skip fire manner further comprises:

determining a selected working chamber for which a firing or skip command is required;

determining whether the selected working chamber is deactivatable;

if the selected working chamber is deactivatable, applying a firing algorithm to generate a firing or skip command for the selected working chamber; and if the selected working chamber is non-deactivatable, arranging for the firing of the selected working chamber without applying the firing algorithm.

6. A method as recited in claim 1 wherein the operating of the engine in a skip fire manner further comprises:

selecting a firing fraction from a library of one or more predetermined firing fractions wherein each firing fraction indicates a percentage of working chambers to fire to deliver a desired output;

determining a firing sequence based on the firing fraction; and operating one or more of the working chambers of the engine based on the firing sequence.

7. A method as recited in claim 6 wherein the selected firing fraction is selected based on one selected from the group consisting of a fill rate and an emptying rate of an intake manifold.

8. A method as recited in claim 1 wherein the operating of the engine in a skip fire manner further comprises:

selecting a firing sequence from a library of one or more predetermined firing sequences.

9. An engine controller for managing transitions between operational states of an internal combustion engine having a plurality of working chambers, the engine controller comprising:

a fire control unit arranged to operate the engine in one of a first displacement and a second displacement, each displacement having an associated fixed set of active working chambers wherein the number of active working chambers associated with the first displacement is different than the number of active working chambers associated with the second displacement and wherein the number of active working chambers associated with each of the first and second displacements is greater than zero; and a firing timing determination module arranged to generate a firing sequence that operates at least one or more of the working chambers of the engine in a skip fire manner during a transition between the first and second displacements wherein the transition between the first and second displacements has a duration of less than five seconds and wherein during skip fire operation at least one of the active working chambers is fired during a first working cycle, skipped during a subsequent second working cycle and fired during a third working cycle that is subsequent to the second working cycle, the first, second and third working cycles occurring during the transition.

10. An engine controller as recited in claim 9 wherein the first and second operational states each involve different, predetermined numbers of non-deactivatable working chambers that are fired at every engine cycle during a particular displacement.

11. An engine controller as recited in claim 9 wherein the operation of the engine in a skip fire manner involves deactivating at least one selected working cycle of at least one selected working chamber and firing at least one selected working cycle of at least one selected working chamber wherein individual working chambers are sometimes deactivated and sometimes fired.

12. An engine controller as recited in claim 9 wherein the firing timing determination module is further arranged to:

generate a firing sequence that includes one or more firing and skip commands for operating the working chambers of the engine;

determinine which working chamber a particular skip command would be applied to;

if the skip command involves a deactivatable working chamber, skip the deactivatable working chamber; and if the skip command involves a non-deactivatable working chamber, fire the non-deactivatable working chamber.

13. An engine controller as recited in claim 9 wherein the firing timing determination module is further arranged to:

determine a selected working chamber for which a firing or skip command is required;

determine whether the selected working chamber is deactivatable;

if the selected working chamber is deactivatable, apply a firing algorithm to generate a firing or skip command for the selected working chamber; and if the selected working chamber is non-deactivatable, arrange for the firing of the selected working chamber without applying the firing algorithm.

14. An engine controller as recited in claim 9 further comprising a firing fraction signal library that includes a library of one or more predetermined firing fractions, each firing fraction indicating a percentage of working chambers to fire to deliver a desired output wherein the engine controller is arranged to select a firing fraction from the library and wherein the firing timing determination module is arranged to determine the firing sequence based on the selected firing fraction.

15. An engine controller as recited in claim 14 wherein the selected firing fraction is selected based on one selected from the group consisting of a fill rate and an emptying rate of an intake manifold.

16. An engine controller as recited in claim 9 further comprising a firing decision sequence library that stores one or more predetermined firing sequences wherein the firing timing determination module is arranged to select the firing sequence from the library.

17. A method for managing transitions between operational states of an internal combustion engine having a plurality of working chambers, the method comprising:

operating the engine in one of a first displacement and a different, second displacement, each displacement having an associated fixed set of active working chambers wherein the number of active working chambers associated with the first displacement is different than the number of active working chambers associated with the second displacement and wherein the number of active working chambers associated with each of the first and second displacements is greater than zero;

making a transition between the first displacement and the second displacement;

during the transition, selecting a firing parameter from the group consisting of a plurality of predetermined firing fractions stored in a firing fraction library and a plurality of firing sequences stored in a firing sequence library; and operating the engine in a skip fire manner during the transition to deliver the selected firing parameter wherein during skip fire operation at least one of the active working chambers is fired during a first working cycle, skipped during a subsequent second working cycle and fired during a third working cycle that is subsequent to the second working cycle, the first, second and third working cycles occurring during the transition.

18. A method as recited in claim 17 wherein the first and second displacements each involve different, predetermined numbers of non-deactivatable working chambers that are fired at every engine cycle during a particular operational state.

19. A method as recited in claim 1 wherein the number of active working chambers associated with the first displacement is the total number of working chambers in the engine.

20. A method as recited in claim 9 wherein the number of active working chambers associated with the first displacement is the total number of working chambers in the engine.

21. A method as recited in claim 17 wherein the number of active working chambers associated with the first displacement is the total number of working chambers in the engine.

22. A method as recited in claim 1 wherein the first, second and third working cycles are not necessarily sequential working cycles.

23. A method as recited in claim 1 wherein:

the first and second displacements involve different, predetermined numbers of active working chambers and wherein every active working chamber is fired at every engine cycle while the engine is being operated in the first and second displacements; and the skip fire engine operation does not require any active working chamber to be fired at every engine cycle.

* * * * *